United States Patent [19]

Engel et al.

[11] Patent Number: 4,913,179

[45] Date of Patent: Apr. 3, 1990

[54] DEVICE FOR WASHING OFF THE INNER SURFACE OF A REACTION VESSEL AND/OR OF THE OUTER SURFACE OF A SPHEROIDAL REAGENT BODY

[75] Inventors: Wolf D. Engel, Pähl; Johann Karl, Weilheim; Friedrich Stäbler, Tutzing, all of Fed. Rep. of Germany

[73] Assignee: Boehringer Mannheim GmbH, Mannheim-Waldhof, Fed. Rep. of Germany

[21] Appl. No.: 288,996

[22] Filed: Dec. 23, 1988

[30] Foreign Application Priority Data

Jan. 8, 1988 [DE] Fed. Rep. of Germany ..... 3800379

[51] Int. Cl.[4] ..... B08B 3/04; B08B 9/08

[52] U.S. Cl. ..... 134/113; 15/302; 134/166 R; 134/182; 134/198; 141/59; 141/91; 141/96; 239/124; 422/99

[58] Field of Search ..... 134/57 R, 166 R, 169 R, 134/182, 198; 15/302, 304; 422/99; 239/104, 119, 120, 124, 125; 141/59, 91, 92, 95, 96

[56] References Cited

U.S. PATENT DOCUMENTS

| | | | |
|---|---|---|---|
| 3,912,535 | 10/1975 | Rauser | 141/91 X |
| 3,949,771 | 4/1976 | Dodge et al. | 134/198 X |
| 4,341,568 | 7/1982 | Christensen | 134/198 X |
| 4,506,709 | 3/1985 | Dennhardt | 141/95 |
| 4,530,384 | 7/1985 | Boyes | 141/95 |
| 4,685,480 | 8/1987 | Eck | 134/198 X |
| 4,749,010 | 6/1988 | Petell | 141/59 |

FOREIGN PATENT DOCUMENTS

| | | | |
|---|---|---|---|
| 209353 | 1/1987 | European Pat. Off. . | |
| 1942201 | 7/1970 | Fed. Rep. of Germany . | |
| 3511078 | 10/1986 | Fed. Rep. of Germany | 141/91 |
| 2354555 | 1/1976 | France . | |

*Primary Examiner*—Philip R. Coe

*Attorney, Agent, or Firm*—Foley & Lardner, Schwartz, Jeffery, Schwaab, Mack, Blumenthal & Evans

[57] ABSTRACT

The present invention provides a device for washing off the inner surface of a reaction vessel and/or of the outer surface of at least one spherodial reagent body present in the reaction vessel, the device comprising a small tube (6) connectable to a washing liquid suction device having a suction opening (2) and being pressable by means of a spring (4) in the direction of the bottom of the reaction vessel, a mantle (8) radially surrounding the small tube (6) at an axial distance from its suction opening (2), which mantle bounds between its inner surface and the outer surface of the small tube (6) a washing liquid inlet canal (10) connectable to a washing liquid supply device, holes (12) being provided in an end section of the mantle (8) facing the suction opening (2) for the exit of the washing liquid and two electrodes (14,16) arranged outside the mantle (8) at a distance from one another, axially further remote from the suction opening (2) than the holes (12) in the mantle (8), the electrodes (14,16) being connectable to an electric liquid level sensor, wherein the inner surface (18) of the suction opening (2) is funnel-shaped.

7 Claims, 1 Drawing Sheet

Figure 1:
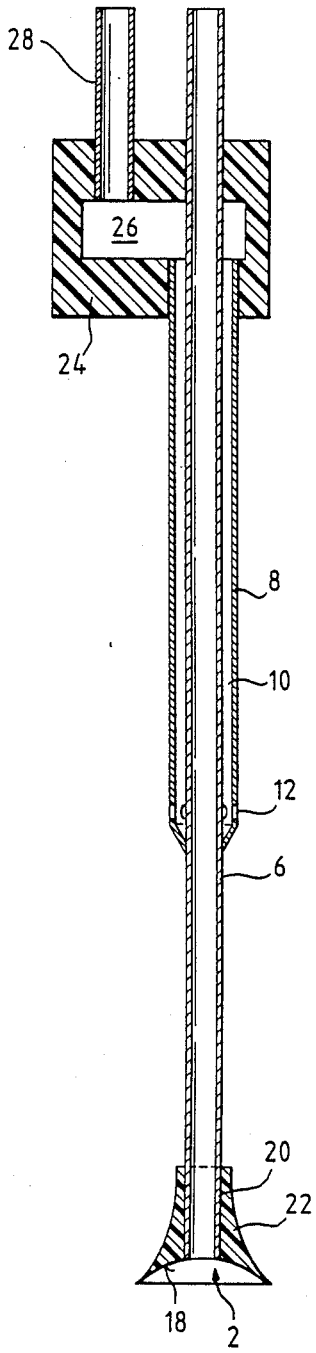

DEVICE FOR WASHING OFF THE INNER SURFACE OF A REACTION VESSEL AND/OR OF THE OUTER SURFACE OF A SPHEROIDAL REAGENT BODY

The present invention is concerned with a device for washing off the inner surface of a reaction vessel and/or of the outer surface of at least one spheroidal reagent body present in the reaction vessel, said device comprising a small tube connectable to a washing liquid suction device having a suction opening and being pressable by means of a spring in the direction of the bottom of the reaction vessel, a mantle radially surrounding the small tube at an axial distance from its suction opening, which mantle bounds between its inner surface and the outer surface of the small tube a washing liquid inlet canal connectable to a washing liquid supply device, holes being provided in an end section of the mantle facing the suction opening for the exit of the washing liquid and two electrodes arranged outside the mantle at a distance from one another, axially further remote from the suction opening than the holes in the mantle, said electrodes being connectable to an electric liquid level sensor.

In the case of chemical binding reactions and especially in the case of immunological tests, which use reaction vessels, whose inner walls are coated with a specific binding reagent, it is necessary, after addition of the binding sample, which is dissolved in a liquid, to remove the liquid from the test tube after a reaction period and then to wash the layer of reagent and specific binding sample components which were bound to the inner wall of the reagent vessel, to remove the unspecific binding sample components are removed.

For this purpose, there has hitherto been used a device which permits the sucking off of the liquid from the reaction vessel through a small tube and also makes possible, after the sucking off, the introduction via an inlet canal of a washing liquid into the reagent vessel, in which the inflowing amount of wash liquid can be automatically regulated via electrodes which are connected to a liquid level sensor. The lower end of the tube thereby serves as the suction opening of the device, the width of opening of this lower end corresponding to the diameter of the small tube. In order to suck out the liquid from the reaction vessel as completely as possible and thus to achieve a thorough washing of the coated walls of the reaction vessel, the previously used device was pressed against the bottom of the reaction vessel by a spring applied to the upper end of the device. In order that the liquid could also be sucked off when the small tube lay on the bottom of the reaction vessl, the lower end of the small tube functioning as suction opening was notched on two opposite-lying positions.

However, chemical binding reactions and immunological tests are today often carried out in an automated manner in which alternatingly there are used not only reaction vessels with reagent-coated inner walls but also reagent vessels which contain reagent-coated spheroidal reagent bodies (so-called beads). The use of reaction vessels with reagent-coated inner walls containing spheroidal reagent bodies is also possible. However, for the removal of the sample liquid and for washing the reagent vessels which contain spheroidal reagent bodies, the previously used devices for sucking off and washing are not very suitable since their suction opening lies above on the spheroidal reagent body and as soon as the liquid level drops below the height of the suction opening, a sucking off of the liquid surrounding the spheroidal reagent body is not possible.

Therefore, it is an object of the present invention to provide a device of the above-defined kind which makes possible, in the same automatic analysers, a complete removal of the liquid and a thorough washing of the surfaces not only in the case of reaction vessels with a reagent-coated inner surface but also in the case of reaction vessels which contain a spheroidal reagent body.

Thus, according to the present invention, there is provided a device for washing off the inner surface of a reaction vessel and/or of the outer surface of at least one spheroidal reagent body present in the reaction vessel, said device comprising a small tube connectable to a washing liquid suction device having a suction opening and being pressable by means of a spring in the direction of the bottom of the reaction vessel, a mantle radially surrounding the small tube at an axial distance from its suction opening, which mantle bounds between its inner surface and the outer surface of the small tube a washing liquid inlet canal connectable to a washing liquid supply device, holes being provided in an end suction of the mantle facing the suction opening for the exit of the washing liquid and two electrodes arranged outside the mantle at a distance from one another, axially further remote from the suction opening than the holes in the mantle, said electrodes being connectable to an electric liquid level sensor, wherein the inner surface of the suction opening is funnel-shaped.

The small tube of the device according to the present invention is, in contradistinction to a device according to the prior art, shortened on its end on the suction side by the diameter of the spheroidal reagent body and has a funnel-shaped suction opening, the diameter of which is preferably at least as great as the diameter of the spheroidal reagent body.

The device according to the present invention is introduced into the reaction vessel before or after the addition of a sample present dissolved in a liquid and placed by means of the spring over the spheroidal reagent body, if present. If the reaction vessel does not contain a spheroidal reagent body, then the device is dipped about just as deeply in the reaction vessel as if the spheroidal reagent body were present, i.e. the suction opening of the device does not sit on the bottom of the reaction vessel. After a reaction period, the liquid is sucked out via the suction opening of the small tube and thereafter the wash liquid is introduced into the reaction vessel via the inlet canal. The addition of the wash liquid is hereby interrupted as soon as the liquid level in the reaction vessel touches both electrodes. This takes place automatically via a connection of the electrodes to an electric liquid level sensor and a closure mechanism on the wash liquid inlet device connected therewith. The wash liquid is then removed in the manner already described for the wash liquid. Due to the funnel shape of the suction opening, damage to the reagent layer on a spheroidal reagent body is avoided and the complete sucking off of the liquid surrounding a spheroidal reagent body is also made possible. With the device according to the present invention, the sucking off of liquid and washing in the case of reaction vessels with spheroidal reagent bodies takes place better and, surprisingly, also in the case of reaction vessels without spheroidal reagent bodies, just as well as with a known device (see the following Examples 1 and 2).

In order to be able to place the suction opening especially well on a spheroidal reagent body, the inner surface of the suction opening is preferably domed concavely in axial section. Especially preferably, the inner surface of the suction opening is adapted to the outer surface of the spheroidal reagent body in the manner of a hollow spherical dome.

According to a further preferred embodiment of the present invention, the suction opening is formed in a separate piece fixed on to the free end of the small tube. In this embodiment, the funnel shape of the suction opening can be formed by a separate piece affixed to the free end of the small tube, this piece preferably being slipped on to the free end of the small tube.

In order to be able to fix on to the free end of the small tube pieces of different sizes with different funnel-shaped, preferably concave hollow spherically-domed inner surfaces and, therefore, in order to adapt the suction opening of the device to the particular size of the spheroidal reagent body used, it is preferable for the piece to be disconnectably attached to the free end of the small tube.

Figure 2:
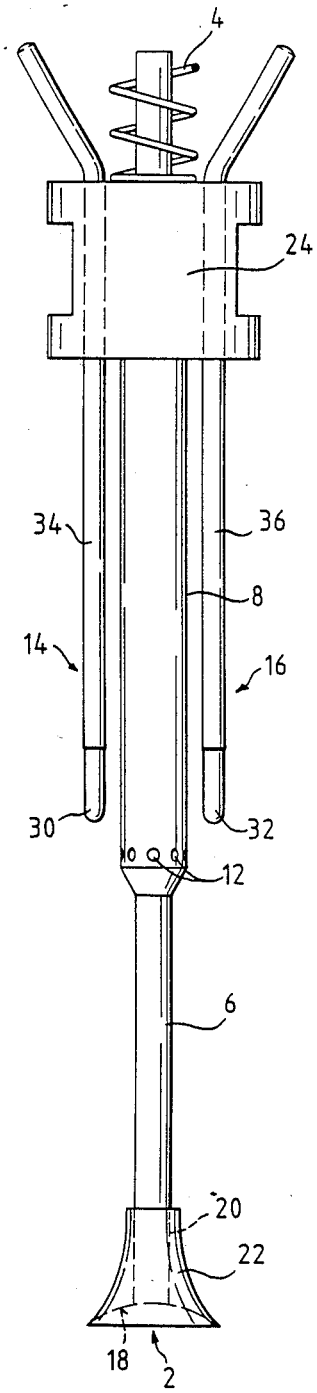

One embodiment of the device according to the present invention is described in the following, with reference to the accompanying drawings, in which FIG. 1 is a vertical section through the device; and FIG. 2 is a view of the device rotated about its vertical axis by 90° in comparison with the illustration in FIG. 1.

The device in the illustrated embodiment has a suction opening 2, the inner surface 18 of which is concavely domed in axial section and is bounded by a piece 22 pushed on to the free end 20 of a small tube 6. The outer surface of the small tube 6 and a mantle 8, radially surrounding the tube 6 and axially displaced from its suction opening 2, bounds a wash liquid inlet canal 10 which opens into an inner chamber 26 of a head part 24. The tube 6 passes through the inner chamber 26. The inner chamber 26 of the head part 24 can be connected via a further tube 28 to a wash liquid inlet device. In the end of the mantle 8 facing the suction opening 2 are present holes 12 through which the wash liquid emerges from the wash liquid inlet canal 10.

Two electrodes 14 and 16 passed through the head part 24 can be connected to an electric liquid level sensor. Up to the free-lying end sections 30 and 32, the electrodes are enclosed by insulation mantles 34 and 36. A spring 4 encompassing the upper end of the small tube 6 presses the head part 24 in the direction of the bottom of a reaction vessel.

The following Examples are given for the purpose of illustrating the present invention:

EXAMPLE 1

The effectiveness of the washing with the device according to the present invention in comparison with a known device shortened by the diameter of the spheroidal reagent body was tested in a reagent vessel containing a spheroidal reagent body ("bead", polystyrene sphere with a diameter of 6.3 mm.).

For this purpose, a spheroidal body coated with bovine serum albumin and a conjugate of carcinoembryonic antigen (CEA) and peroxidase was placed in a reaction vessel which was also coated with bovine serum albumin and CEA-peroxidase. The more effective is the washing, the more of the adsorptively-bound CEA conjugate should be dissolved off. Consequently, when washing has been good, the smallest possible measurement value would be obtained in a subsequent colour reaction.

The colour reaction was carried out by adding 500 ml. of a reagent consisting of ABTS (2,2'-azino-di-[3-ethylbenzthiazoline-6-sulphonic acid] diammonium salt) and sodium perborate and, after 45 minutes, measuring the extinction at 422 nm.

The results obtained are set out in the following Table I in which are given the number of washing steps, as well as the size of the measurement signal at 422 nm in mE. It can be seen that, with the device according to the present invention, the suction opening of which was formed as a synthetic material piece on the free end of the small tube, substantially smaller measurement signals are obtained and thus a better washing is achieved. Furthermore, the coefficient of variation, (CV), which represents a measure of the exactitude, is smaller with the device according to the present invention.

TABLE I

Optimising of the washing in the case of 6.3 mm. beads

| number of washing steps | shortened known washing device: signal (mE extinction) | shortened known washing device: variation CV (n = 9)* | washing device according to the present invention with synthetic material piece (Ø 7 mm.): signal (mE extinction) | washing device according to the present invention with synthetic material piece (Ø 7 mm.): variation CV (n = 9)* |
|---|---|---|---|---|
| 3 | 746 | 25.9 | 447 | 7.7 |
| 6 | 495 | 14.3 | 304 | 14.5 |
| 8 | 343 | 14.4 | — | — |
| 10 | 311 | 10.9 | 197 | 5.6 |

*n = number of measurements

EXAMPLE 2

TSH immunodetermination

A TSH-Enzymuntest® TSH (thyroid-stimulating hormone) was carried out with a device according to the present invention in comparison with a known device, the test tube wall being coated. The test tube did not contain a spheroidal reagent body. The solutions used, the coated tubes and the standards originated from the Enzymuntest® TSH (Boehringer Manneheim GmbH, Order No. 736083). The determination was carried out analogously to the manufacturer's instructions.

Into test tubes coated with anti-TSH antibodies was introduced 1 ml of Solution 1:

| | |
|---|---|
| phosphate buffer | 15 mMole/l. (pH 6.9) |
| bovine serum albumin | 0.2% by wt. |
| merthiolate | 0.01% by wt. |

followed by incubation for 60 minutes at 20° to 25° C. After sucking out and rinsing six times, 1 ml of a solution of 40 U/1 of anti-TSH-peroxidase conjugate in the above-described buffer was added thereto and incubation carried out for 60 minutes at 20° to 25° C. The test tube was sucked out and rinsed 6 times. Thereafter, there was added 1 ml of a solution consisting of

| | |
|---|---|
| phosphate-citrate buffer | 95 mMole/l. (pH 4.4) |
| sodium perborate | 3.1 mMole/l. |
| 2,2'-azino-di-[3-ethyl-benzthiazoline-6-sulphonic acid] | 1.9 mMole/l. |

-continued

| |
|---|
| diammonium salt |

and incubation carried out for 45 minutes at 20° to 25° C. Thereafter a photometric determination was carried out at $\lambda = 422$ nm against the last-mentioned solution as blank. The following Table II shows the measurement results obtained with various standards. It follows therefrom that, with the device according to the present invention, there can be obtained results which are as comparably good as with a known device for wall-coated immunoassays.

TABLE II

| | known device | | shortened device according to the present invention, synthetic material piece | |
|---|---|---|---|---|
| | signal (mE) | CV (%) (n = 9)* | signal (mE) | CV (%) (n = 10)* |
| standard a | 13 ± 1.9 | 14.7 | 12 ± 1.3 | 10.8 |
| standard b | 48 ± 4.5 | 9.4 | 60 ± 6.3 | 6.4 |
| standard c | 98 ± 4.9 | 5.0 | 119 ± 4.3 | 3.5 |
| standard d | 263 ± 7.6 | 2.9 | 333 ± 10.3 | 3.1 |
| standard e | 503 ± 16.4 | 3.3 | 617 ± 17.3 | 2.8 |
| standard f | 876 ± 8.7 | 1.0 | 1077 ± 23.4 | 2.2 |
| standard g | 1508 ± 23.4 | 1.6 | 1895 ± 42.0 | 2.2 |

*n = number of measurements.

We claim:

1. Device for washing off the inner surface of a reaction vessel and/or of the outer surface of at least one spheroidal reagent body present in the reaction vessel, said device comprising a small tube (6) connectable to a washing liquid suction device having a suction opening (2) and being pressable by means of a spring (4) in the direction of the bottom of the reaction vessel, a mantle (8) radially surrounding the small tube (6) at an axial distance from its suction opening (2), which mantle bounds between its inner surface and the outer surface of the small tube (6) a washing liquid inlet canal (10) connectable to a washing liquid supply device, holes (12) being provided in an end section of the mantle (8) facing the suction opening (2) for the exit of the washing liquid and two electrodes (14,16) arranged outside the mantle (8) at a distance from one another, axially further remote from the suction opening (2) than the holes (12) in the mantle (8), said electrodes (14,16) being connectable to an electric liquid level sensor, wherein the inner surface (18) of the suction opening (2) is funnel-shaped.

2. Device according to claim 1, wherein the inner surface (18) of the suction opening (2) is concavely domed in axial section.

3. Device according to claim 2, wherein the inner surface (18) of the suction opening (2) is adapted to the outer surface of the spheroidal reagent body in the manner of a hollow spherical dome.

4. Device according to claim 1, wherein the suction opening (2) is formed in a separate piece (22) affixed to the free end (20) of the small tube (6).

5. Device according to claim 4, wherein the piece (22) is slipped on to the free end (20) of the small tube (6).

6. Device according to claim 5, wherein the piece (22) is disconnectably attached to the free end (20) of the small tube (6).

7. Device according to claim 4, wherein the piece (22) is disconnectably attached to the free end (20) of the small tube (6).

* * * * *